US009834833B2

(12) United States Patent
Minoda et al.

(10) Patent No.: US 9,834,833 B2
(45) Date of Patent: Dec. 5, 2017

(54) ALUMINUM ALLOY MATERIAL EXHIBITING EXCELLENT BENDABILITY AND METHOD FOR PRODUCING THE SAME

(75) Inventors: Tadashi Minoda, Nagoya (JP); Yasuhiro Nakai, Nagoya (JP)

(73) Assignee: UACJ CORPORATION, Tokyo (JP)

( * ) Notice: Subject to any disclaimer, the term of this patent is extended or adjusted under 35 U.S.C. 154(b) by 0 days.

(21) Appl. No.: 14/118,789

(22) PCT Filed: Oct. 6, 2011

(86) PCT No.: PCT/JP2011/073059

§ 371 (c)(1),
(2), (4) Date: Nov. 19, 2013

(87) PCT Pub. No.: WO2012/160720

PCT Pub. Date: Nov. 29, 2012

(65) Prior Publication Data

US 2014/0083575 A1 Mar. 27, 2014

(30) Foreign Application Priority Data

May 20, 2011 (JP) ..... 2011-113235
Oct. 5, 2011 (JP) ..... 2011-220785

(51) Int. Cl.
*C22F 1/057* (2006.01)
*C22C 21/16* (2006.01)
*C22C 21/14* (2006.01)

(52) U.S. Cl.
CPC ..... *C22F 1/057* (2013.01); *C22C 21/14* (2013.01); *C22C 21/16* (2013.01)

(58) Field of Classification Search
CPC ..... C22F 1/057; C22C 21/14; C22C 21/16
See application file for complete search history.

(56) References Cited

U.S. PATENT DOCUMENTS 5,269,349 A * 12/1993 Sugier et al. ..... 138/172
2006/0243359 A1* 11/2006 Sano et al. ..... 148/689

FOREIGN PATENT DOCUMENTS

| | | | | |
|---|---|---|---|---|
| JP | 04-325647 | | 11/1992 | |
| JP | 05-112839 | | 5/1993 | |
| JP | 05-306440 | | 11/1993 | |
| JP | 07-166285 | | 6/1995 | |
| JP | 07166285 | A * | 6/1995 | ..... C22C 21/02 |
| JP | 07-305135 | | 11/1995 | |
| JP | 08-269608 | | 10/1996 | |
| JP | 08-269652 | | 10/1996 | |
| JP | 10-130769 | | 5/1998 | |
| JP | 2006307241 | A * | 11/2006 | |
| WO | WO 2004/090186 | | 10/2004 | |
| WO | WO 2008/072776 | | 6/2008 | |

OTHER PUBLICATIONS

International Search Report of PCT/JP2011/073059 (3 pages).

* cited by examiner

*Primary Examiner* — Rebecca Lee
(74) *Attorney, Agent, or Firm* — Flynn, Thiel, Boutell & Tanis, P.C.

(57) ABSTRACT

An aluminum alloy material exhibiting excellent bendability can be produced without performing a straightening step, and can be bent without developing orange peel. The aluminum alloy material is a T4-tempered material formed of an Al—Cu—Mg—Si alloy including 1.0 to 2.5 mass % of Cu, 0.5 to 1.5 mass % of Mg, and 0.5 to 1.5 mass % of Si, with the balance being aluminum and unavoidable impurities, a matrix that forms an inner part of the aluminum alloy material having a microstructure formed by recrystallized grains having an average crystal grain size of 200 μm or less, and the aluminum alloy material having a ratio of tensile strength/yield strength determined by a tensile test of 1.5 or more.

8 Claims, No Drawings

ALUMINUM ALLOY MATERIAL EXHIBITING EXCELLENT BENDABILITY AND METHOD FOR PRODUCING THE SAME

BACKGROUND

The invention relates to an aluminum alloy material exhibiting excellent bendability, and a method for producing the same.

A high-strength aluminum alloy has been widely used for transportation machines such as motorcycles in order to implement a reduction in weight. In particular, 2000 series aluminum alloys (e.g., 2017 alloy and 2024 alloy) have been widely applied to structural members due to excellent fatigue strength. These aluminum alloys are normally used as a T3-tempered material, a T4-tempered material, a T6-tempered material, a T8-tempered material, or the like.

An aluminum alloy material used for structural members of transportation machines may be subjected to bending depending on the application. However, when a T3-tempered material, a T4-tempered material, a T6-tempered material, a T8-tempered material, or the like formed of a 2000 series aluminum alloy is subjected to bending, cracks may occur during bending due to too high a strength, or a change in shape may occur due to a large amount of spring-back.

Therefore, a 2000 series aluminum alloy is normally O-tempered, bent, and then subjected to a solution treatment and quenching to prepare a T3-tempered material, a T4-tempered material, a T6-tempered material, a T8-tempered material, or the like. However, since deformation occurs during quenching, it is necessary to perform straightening (i.e., an increase in cost occurs). Therefore, a reduction in cost through omission of straightening has been desired.

For example, a reduction in cost through omission of straightening has been desired for a T4-tempered material formed of a 2024 alloy that is used to form an extruded pipe and subjected to bending. Since an extruded pipe formed of a 2024 alloy has a configuration in which the inner part of the material has a fiber structure (texture) and the surface area of the material has a coarse recrystallized structure, orange peel may occur during bending, and the external appearance may deteriorate. Therefore, it has been desired to suppress the occurrence of orange peel during bending by controlling the structure.

JP-A-4-000353 discloses related-art technology.

SUMMARY OF THE INVENTION

The inventors of the invention conducted extensive studies in order to solve the above problems that may occur when bending a T4-tempered material formed of an Al—Cu—Mg—Si alloy, and found that the bendability of the material is affected by the average crystal grain size of the microstructure of the matrix that forms the inner part of the material, the ratio of tensile strength/yield strength of the material determined by a tensile test, and the grain boundary coverage by precipitates (i.e., the grain boundary coverage by precipitates in the matrix).

The invention was achieved as a result of further experiments and studies based on the above finding. An object of the invention is to provide an aluminum alloy material exhibiting excellent bendability that can be produced without performing a straightening step, and can be subjected to bending without developing orange peel, and a method for producing the same.

According to a first aspect of the invention, there is provided an aluminum alloy material exhibiting excellent bendability, the aluminum alloy material being a T4-tempered material formed of an Al—Cu—Mg—Si alloy including 1.0 to 2.5 mass % of Cu, 0.5 to 1.5 mass % of Mg, and 0.5 to 1.5 mass % of Si, with the balance being aluminum and unavoidable impurities, a matrix that forms an inner part of the aluminum alloy material having a microstructure formed by recrystallized grains having an average crystal grain size of 200 μm or less, and the aluminum alloy material having a ratio of tensile strength/yield strength determined by a tensile test of 1.5 or more. Note that the unit "mass %" may be referred to as "%".

In the aluminum alloy material exhibiting excellent bendability, the Al—Cu—Mg—Si alloy may further include at least one of 0.35 mass % or less (excluding 0%, hereinafter the same) of Mn, 0.30 mass % or less of Cr, 0.15 mass % or less of Zr, and 0.15 mass % or less of V.

In the aluminum alloy material exhibiting excellent bendability, the Al—Cu—Mg—Si alloy may further include at least one of 0.15 mass % or less of Ti and 50 ppm or less of B.

In the aluminum alloy material exhibiting excellent bendability, the matrix that forms the inner part of the aluminum alloy material may have a grain boundary coverage by precipitates of 30% or less.

The aluminum alloy material may be a pipe material.

According to a second aspect of the invention, there is provided a method for producing the aluminum alloy material exhibiting excellent bendability according to the first aspect of the invention, the method including homogenizing a billet of an Al—Cu—Mg—Si alloy having the above composition at 520 to 560° C. for 2 hours or more, cooling the homogenized billet to room temperature, heating the cooled billet to 300 to 500° C., subjecting the heated billet to hot extrusion so that a product exits from a platen of an extruder at a speed of 10 m/min or more and an extrusion ratio is 30 or more to obtain an extruded material, cooling the extruded material to room temperature, heating the cooled extruded material to 350 to 400° C., softening the heated extruded material at 350 to 400° C. for 30 minutes or more, subjecting the softened extruded material to cold working at room temperature at a working ratio of 15% or more, subjecting the cold-worked extruded material to a solution treatment at 530 to 560° C. for 10 minutes or more, cooling the extruded material subjected to the solution treatment to room temperature so that an average cooling rate down to 100° C. is 10° C./sec or more, and subjecting the cooled extruded material to natural aging at room temperature for 7 days or more.

In the method for producing the aluminum alloy material exhibiting excellent bendability, the extruded material subjected to the solution treatment may be cooled to room temperature so that the average cooling rate down to 100° C. is 10° C./sec or more, subjected to stretch straightening at room temperature by 3% or less, and subjected to natural aging at room temperature for 7 days or more.

In the method for producing the aluminum alloy material exhibiting excellent bendability, the homogenized billet may be cooled to 300 to 500° C., and subjected to hot extrusion.

In the method for producing the aluminum alloy material exhibiting excellent bendability, the extruded material obtained by hot extrusion may be cooled to 350 to 400° C., and softened at 350 to 400° C. for 30 minutes or more.

The aspects of the invention thus provide an aluminum alloy material exhibiting excellent bendability that can be produced without performing a straightening step, and can be subjected to bending without developing orange peel as a result of controlling the structure thereof, and a method for producing the same.

DESCRIPTION OF EXEMPLARY EMBODIMENTS

The effects of each alloy component of an aluminum alloy material exhibiting excellent bendability according to one embodiment of the invention, and the reasons for limitation to the content of each alloy component are described below.

Cu is an element that bonds to Mg, and improves the strength of the aluminum alloy material. The Cu content is preferably 1.0 to 2.5%. If the Cu content is less than 1.0%, the aluminum alloy material may exhibit insufficient strength. If the Cu content exceeds 2.5%, the strength of the aluminum alloy material may increase to a large extent, and cracks may occur during bending. The Cu content is more preferably 1.3 to 2.2%, and most preferably 1.5 to 2.0%.

Mg is an element that bonds to Cu and Si, and improves the strength of the aluminum alloy material. The Mg content is preferably 0.5 to 1.5%. If the Mg content is less than 0.5%, the aluminum alloy material may exhibit insufficient strength. If the Mg content exceeds 1.5%, the strength of the aluminum alloy material may increase to a large extent, and cracks may occur during bending. The Mg content is more preferably 0.7 to 1.3%, and most preferably 0.8 to 1.2%.

Si is an element that bonds to Mg, and improves the strength of the aluminum alloy material. The Si content is preferably 0.5 to 1.5%. If the Si content is less than 0.5%, the aluminum alloy material may exhibit insufficient strength. If the Si content exceeds 1.5%, the strength of the aluminum alloy material may increase to a large extent, and cracks may occur during bending. The Si content is more preferably 0.6 to 1.2%, and most preferably 0.6 to 1.0%.

Mn, Cr, Zr, and V are optional elements that are selectively added to the aluminum alloy material. Mn, Cr, Zr, and V ensure uniform recrystallization during extrusion, and refine the crystal grains. The Mn content is preferably 0.35% or less, the Cr content is preferably 0.30% or less, the Zr content is preferably 0.15% or less, and the V content is preferably 0.15% or less (excluding 0%). When the aluminum alloy material does not include at least one of Mn, Cr, Zr, and V, the crystal grains of the aluminum alloy material may become coarse depending on the Fe content, and orange peel may occur during bending. If the Mn content, the Cr content, the Zr content, or the V content exceeds the upper limit, coarse crystallized products may be produced during casting, and cracks may easily occur during bending. The Mn content is more preferably 0.20% or less, the Cr content is more preferably 0.10% or less, the Zr content is more preferably 0.08% or less, and the V content is more preferably 0.07% or less.

Ti and B refine the cast structure, and suppress the occurrence of cracks during casting when producing the aluminum alloy material. The Ti content is preferably 0.15% or less, and the B content is preferably 50 ppm or less (excluding 0% or 0 ppm). If the Ti content or the B content exceeds the upper limit, the number of coarse intermetallic compounds may increase, and a deterioration in bendability may occur. The Ti content is more preferably 0.10% or less, and the B content is more preferably 20 ppm or less.

Fe (unavoidable impurities) reduces the crystal grain size of the end product when the Fe content is high. However, Fe produces Al—Fe—Si crystallized products during casting, and may decrease the bendability of the end product. Therefore, it is preferable that the Fe content be as low as possible. However, use of a ground metal having a high purity increases the production cost. The allowable Fe content is 0.5% or less taking account of the balance between cost and bendability. Zn (unavoidable impurities) decreases the corrosion resistance of the aluminum alloy material when the Zn content is high. Therefore, the allowable Zn content is 0.2% or less.

In the aluminum alloy material exhibiting excellent bendability according to one embodiment of the invention, it is preferable that the matrix that forms the inner part of the aluminum alloy material have a microstructure formed by recrystallized grains having an average crystal grain size of 200 μm or less. If the average crystal grain size exceeds 200 μm, orange peel may occur during bending, and the external appearance may deteriorate. The average crystal grain size is more preferably 150 μm or less, and most preferably 100 μm or less.

It is preferable that the aluminum alloy material exhibiting excellent bendability according to one embodiment of the invention have a ratio of tensile strength/yield strength determined by a tensile test of 1.5 or more. If the ratio of tensile strength/yield strength is less than 1.5, cracks may occur during bending. The tensile test is preferably performed using a specimen prepared in accordance with JIS Z 2201. For example, a No. 5 specimen, a No. 13A specimen, a No. 13B specimen, a No. 14B specimen, or the like is preferably used as a sheet-like specimen, a No. 2 specimen, a No. 4 specimen, a No. 14A specimen, or the like is preferably used as a rod-like specimen, and a No. 11 specimen, a No. 12A specimen, a No. 12B specimen, a No. 12C specimen, or the like is preferably used as a pipe-like specimen. A specimen having another shape may also be used, as required. The tensile test is performed at room temperature in accordance with JIS Z 2241.

In the aluminum alloy material exhibiting excellent bendability according to one embodiment of the invention, it is preferable that the matrix that forms the inner part of the aluminum alloy material have a grain boundary coverage by precipitates of 30% or less. Mg—Si-based compounds, Al—Cu-based compounds, Al—Cu—Mg-based compounds, Al—Mg—Si—Cu-based compounds, and the like precipitate in the aluminum alloy material according to one embodiment of the invention during aging. If the grain boundary coverage by these precipitates exceeds 30%, intergranular cracking may easily occur during plastic working, and cracks may occur during bending.

The grain boundary coverage by precipitates is measured using a transmission electron microscope (TEM). A TEM observation specimen (thickness: about 1 mm, width: about 5 mm, length: about 5 mm) is cut (sampled) from the center area of a sheet-like test material in the widthwise direction and the thickness direction, or the center area of a rod-like test material in the diameter direction, or the center area of a pipe-like test material in the thickness direction. The specimen is sampled so that the thickness direction of the specimen coincides with the thickness direction of the sheet-like test material, or the diameter direction of the rod-like test material, or the thickness direction of the pipe-like test material.

When the thickness, the width, and/or the length is less than the above value, a specimen is sampled to have a maximum dimension. The specimen is then polished up to about 40 μm using waterproof abrasive paper, and a TEM structure observation thin piece is prepared by a twin jet polishing method. 20 to 30 photographs of the structure (including the crystal grain boundaries) of the specimen are photographed using a TEM, and the total length L1 of the crystal grain boundaries and the total length L2 of the grain boundary precipitates observed in each photograph are measured. The ratio "L2/L1" is calculated, and taken as the grain boundary coverage by precipitates.

A method for producing an aluminum alloy material exhibiting excellent bendability according to one embodiment of the invention is described below.

Specifically, an Al—Cu—Mg—Si alloy having the above specific composition is melted and cast to obtain a billet. The billet is homogenized at 520 to 560° C. for 2 hours or more, and cooled to room temperature. The crystallized compounds produced during casting are decomposed due to homogenization, and the bendability of the end product is improved. If the homogenization temperature is less than 520° C., or the homogenization time is less than 2 hours, the crystallized compounds produced during casting may not be sufficiently decomposed, and the end product may not exhibit excellent bendability due to a decrease in ductility. If the homogenization temperature exceeds 560° C., the billet may be locally melted.

The homogenized billet is cooled to room temperature for convenience of handling, heated to 300 to 500° C., and extruded. When using equipment designed to continuously implement homogenization and extrusion, the homogenized billet may be cooled to 300 to 500° C. (extrusion temperature), and then extruded without cooling the homogenized billet to room temperature.

The crystal grains of the end product are generally refined when the temperature of the billet before extrusion is low. However, if the temperature of the billet before extrusion is less than 300° C., the deformation resistance may increase to a large extent, and clogging may occur during extrusion. If the temperature of the billet exceeds 500° C., local melting may occur due to the heat generated during extrusion, and cracks may occur in the product. Therefore, the temperature of the billet before extrusion is appropriately selected within such a range that clogging and local melting do not occur.

The speed of the product that exits from the platen of the extruder during extrusion affects the crystal grain size of the end product. In order to ensure that the inner part of the product has a microstructure having an average crystal grain size of 200 μm or less, it is preferable to set the speed of the product that exits from the platen of the extruder to 10 m/min or more. If the speed of the product that exits from the platen of the extruder is less than 10 m/min, the average crystal grain size of the end product may exceed 200 μm. In this case, orange peel may occur during bending, and the external appearance may deteriorate.

The extrusion ratio also affects the crystal grain size of the end product. In order to ensure that the inner part of the product has a microstructure having an average crystal grain size of 200 μm or less, it is preferable to set the extrusion ratio to 30 or more. If the extrusion ratio is less than 30, the average crystal grain size of the end product may exceed 200 μm. In this case, orange peel may occur during bending, and the external appearance may deteriorate.

The extruded material is cooled to room temperature for convenience of handling, heated to 350 to 400° C., and softened at 350 to 400° C. for 30 minutes or more. When using equipment designed to continuously implement extrusion and softening, the extruded product may be cooled to 350 to 400° C. (softening temperature), and then softened without cooling the extruded product to room temperature.

The softening treatment is necessary for performing cold working. The softening temperature is preferably 350 to 400° C. If the softening temperature is less than 350° C., a decrease in strength may be insufficient, and cracks may occur during cold working. If the softening temperature exceeds 400° C., an increase in strength may occur due to dissolution of the main elements such as Cu, Mg, and Si, and cracks may occur during cold working. The softening time is preferably 30 minutes or more. If the softening time is less than 30 minutes, a decrease in strength may be insufficient, and cracks may occur during cold working. The upper limit of the softening time is not particularly limited. It is preferable that the softening time be as short as possible from the viewpoint of the energy cost.

The softened extruded material is cooled to room temperature, and subjected to cold working. The cooling method is appropriately selected from natural cooling outside the furnace, cooling inside the furnace, and the like. The softened extruded material is subjected to cold working at room temperature at a working ratio of 15% or more. When producing a pipe material or a round rod-like material, drawing is normally performed as cold working. When producing sheet-like material, drawing, rolling, or the like is performed as cold working. The crystal grain size of the end product decreases as the cold working ratio increases. However, cracks may occur when the working ratio is too high. Therefore, a moderate working ratio is selected depending on the shape of the product. If the working ratio is less than 15%, the crystal grain size of the end product may exceed 200 μm.

The cold-worked extruded material is subjected to a solution treatment and natural aging to obtain a T4-tempered material. The solution treatment temperature is preferably 530 to 560° C., and the solution treatment time is preferably 10 minutes or more. Recrystallization also occurs in the inner part of the material due to the solution treatment, and the average crystal grain size becomes 200 μm or less. If the solution treatment temperature is less than 530° C., or the solution treatment time is less than 10 minutes, a decrease in strength may occur due to insufficient formation of a solid solution. Moreover, the ratio of tensile strength/yield strength may be less than 1.5, and cracks may occur during bending. If the solution treatment temperature exceeds 560° C., melting may occur.

The extruded material subjected to the solution treatment is quenched to room temperature. It is preferable to quench the extruded material so that the average cooling rate from the solution treatment temperature to 100° C. is 10° C./sec or more. If the average cooling rate from the solution treatment temperature to 100° C. is less than 10° C./sec, precipitation may occur at the crystal grain boundaries, and the grain boundary coverage by precipitates may exceed 30%. As a result, a decrease in bendability and a decrease in strength may occur. The quenched extruded material may be subjected to stretch straightening at room temperature by 3% or less in order to further improve (reduce) twisting and curving. If the extruded material is subjected to stretch straightening by more than 3%, the ratio of tensile strength/yield strength may be less than 1.5 due to an increase in yield strength, and a deterioration in bendability may occur. The lower limit of the amount of stretch straightening is not particularly limited. It is preferable to set the amount of stretch straightening to 0.5% or more in order to advantageously improve (reduce) twisting and curving. It is preferable to subject the extruded material to stretch straightening within 24 hours after quenching. If the extruded material is subjected to stretch straightening when more than 24 hours has elapsed after quenching, the production time may increase, and the load of stretch straightening may increase, although the final material properties are not improved.

Therefore, it is preferable to subject the extruded material to stretch straightening within 24 hours after quenching from the viewpoint of production efficiency or the like. The extruded material is subjected to natural aging for 7 days or more after quenching or stretch straightening to obtain a T4-tempered material.

EXAMPLES

The invention is further described below by way of examples and comparative examples to demonstrate the advantageous effects of the invention. Note that the following examples are provided for illustration purposes only, and the invention is not limited to the following examples.

Example 1

A hollow billet (outer diameter: 280 mm, inner diameter: 85 mm) of an aluminum alloy (alloys A to P) having the composition shown in Table 1 was homogenized at 540° C. for 10 hours, cooled to room temperature, heated to 350° C., and extruded (extrusion ratio: 39.5) using an indirect extrusion method to obtain a pipe-like extruded product having an outer diameter of 95 mm and an inner diameter of 85 mm. The extruded product was cooled to room temperature. The speed of the product exiting from the platen of the extruder was set to 15 m/min.

The extruded product was softened at 380° C. for 1 hour, cooled to room temperature inside the furnace, and drawn (drawing ratio: 24%) at room temperature to have an outer diameter of 90 mm and an inner diameter of 82 mm. The drawn product was placed in an atmospheric furnace held at 540° C., heated to 540° C. over 30 minutes, held at 540° C. for 10 minutes, and quenched in water at room temperature. The drawn product was quenched so that the average cooling rate down to 100° C. was about 100° C./sec. The quenched product was subjected to natural aging at room temperature for 7 days to obtain a test material (test materials 1 to 16).

The average crystal grain size of the inner part of the test material, the ratio of tensile strength/yield strength, the grain boundary coverage by precipitates, and the presence or absence of orange peel after bending were determined by the following methods using the test materials 1 to 16. The results are shown in Table 2.

Crystal grain size: A microstructure observation specimen having a length of 10 mm and an outer circumference of 10 mm was cut from the pipe-like test material. The specimen was embedded in a thermosetting resin so that the plane vertical to the longitudinal direction was the observation plane, roughly polished using a waterproof abrasive paper, subjected to final polishing using alumina powder, and etched using Keller's reagent to prepare a microstructure observation sample. The structure of each sample was photographed using an optical microscope at a magnification of 100, and the crystal grain size in the circumferential direction and the crystal grain size in the thickness direction were determined from the photograph in accordance with JIS H 0501 (cutting method). The average value of the crystal grain size in the circumferential direction and the crystal grain size in the thickness direction was taken as the average crystal grain size.

Ratio of tensile strength/yield strength: A No. 12A tensile specimen in accordance with JIS Z 2201 was sampled from the pipe-like test material, and subjected to a tensile test at room temperature in accordance with JIS Z 2241 to measure the tensile strength and the yield strength of the specimen. The ratio of tensile strength/yield strength was calculated from the measured values.

Grain boundary coverage by precipitates: A specimen having a thickness of about 1 mm, a width of about 5 mm, and a length of about 5 mm was cut (sampled) from the center area of the pipe-like test material in the thickness direction. The specimen was polished up to about 40 μm using a waterproof abrasive paper, and a transmission electron microscope (TEM) structure observation specimen was prepared by a twin jet polishing method. 20 to 30 photographs of the structure (including the crystal grain boundaries) of each specimen were photographed using a TEM, and the total length L1 of the crystal grain boundaries and the total length L2 of the grain boundary precipitates observed in each photograph were measured. The ratio "L2/L1" was calculated, and taken as the grain boundary coverage by precipitates.

Presence or absence of orange peel after bending: The pipe-like test material (length: 1000 mm) was bent in the longitudinal direction at a curvature of 1000 mm, and the presence or absence of orange peel was observed with the naked eye.

TABLE 1

(mass %)

| Alloy | Cu | Mg | Si | Mn | Cr | Zr | V | Ti | B (ppm) | Fe | Zn | Al |
|---|---|---|---|---|---|---|---|---|---|---|---|---|
| A | 1.0 | 0.5 | 0.5 | 0.03 | 0.05 | 0.02 | 0.01 | 0.02 | 18 | 0.06 | 0.00 | Balance |
| B | 1.3 | 0.7 | 0.6 | 0.01 | 0.07 | 0.01 | 0.01 | 0.03 | 26 | 0.15 | 0.01 | Balance |
| C | 1.5 | 0.8 | 0.6 | 0.00 | 0.07 | 0.01 | 0.01 | 0.02 | 19 | 0.14 | 0.01 | Balance |
| D | 1.7 | 1.0 | 0.8 | 0.01 | 0.05 | 0.00 | 0.00 | 0.01 | 12 | 0.17 | 0.00 | Balance |
| E | 2.0 | 1.2 | 1.0 | 0.00 | 0.07 | 0.00 | 0.00 | 0.02 | 18 | 0.08 | 0.00 | Balance |
| F | 2.2 | 1.3 | 1.2 | 0.01 | 0.06 | 0.00 | 0.01 | 0.03 | 24 | 0.22 | 0.00 | Balance |
| G | 2.5 | 1.5 | 1.5 | 0.02 | 0.08 | 0.00 | 0.00 | 0.03 | 29 | 0.10 | 0.00 | Balance |
| H | 1.7 | 1.0 | 0.8 | 0.01 | 0.02 | 0.00 | 0.00 | 0.01 | 13 | 0.06 | 0.00 | Balance |
| I | 1.7 | 0.9 | 0.8 | 0.19 | 0.10 | 0.07 | 0.06 | 0.02 | 22 | 0.12 | 0.01 | Balance |
| J | 1.8 | 1.0 | 0.8 | 0.34 | 0.00 | 0.00 | 0.00 | 0.02 | 18 | 0.11 | 0.02 | Balance |
| K | 1.7 | 1.0 | 0.7 | 0.00 | 0.28 | 0.00 | 0.00 | 0.01 | 15 | 0.15 | 0.00 | Balance |
| L | 1.7 | 0.9 | 0.9 | 0.00 | 0.00 | 0.14 | 0.00 | 0.02 | 17 | 0.18 | 0.00 | Balance |
| M | 1.7 | 1.0 | 0.7 | 0.00 | 0.00 | 0.00 | 0.15 | 0.03 | 22 | 0.09 | 0.01 | Balance |
| N | 1.7 | 1.0 | 0.8 | 0.01 | 0.10 | 0.00 | 0.01 | 0.14 | 49 | 0.12 | 0.02 | Balance |
| O | 1.6 | 1.1 | 0.7 | 0.00 | 0.08 | 0.00 | 0.00 | 0.02 | 15 | 0.47 | 0.00 | Balance |
| P | 1.7 | 0.9 | 0.7 | 0.01 | 0.09 | 0.01 | 0.01 | 0.01 | 16 | 0.08 | 0.17 | Balance |

TABLE 2

| Test material | Alloy | Average crystal grain sizes (μm) | Tensile strength (MPa) | Yield strength (MPa) | Tensile strength/ yield strength | Grain boundary coverage by precipitates (%) | Presence or absence of orange peel after bending |
|---|---|---|---|---|---|---|---|
| 1 | A | 60 | 221 | 138 | 1.6 | 2 | Absent |
| 2 | B | 61 | 264 | 167 | 1.6 | 4 | Absent |
| 3 | C | 62 | 308 | 194 | 1.6 | 4 | Absent |
| 4 | D | 66 | 356 | 224 | 1.6 | 5 | Absent |
| 5 | E | 65 | 374 | 230 | 1.6 | 5 | Absent |
| 6 | F | 63 | 390 | 236 | 1.7 | 7 | Absent |
| 7 | G | 63 | 409 | 245 | 1.7 | 8 | Absent |
| 8 | H | 176 | 341 | 222 | 1.5 | 8 | Absent |
| 9 | I | 30 | 367 | 231 | 1.6 | 3 | Absent |
| 10 | J | 48 | 362 | 228 | 1.6 | 4 | Absent |
| 11 | K | 49 | 361 | 228 | 1.6 | 4 | Absent |
| 12 | L | 49 | 363 | 234 | 1.6 | 5 | Absent |
| 13 | M | 47 | 363 | 235 | 1.5 | 4 | Absent |
| 14 | N | 60 | 354 | 220 | 1.6 | 6 | Absent |
| 15 | O | 58 | 358 | 225 | 1.6 | 5 | Absent |
| 16 | P | 59 | 355 | 224 | 1.6 | 5 | Absent |

As shown in Table 2, when using the test materials 1 to 16, the inner part of the test material had a microstructure having an average crystal grain size of 200 μm or less, the ratio of tensile strength/yield strength was 1.5 or more, the grain boundary coverage by precipitates was 30% or less, and orange peel was not observed after bending (i.e., the test materials 1 to 16 exhibited excellent bendability).

Example 2

A hollow billet (outer diameter: 280 mm, inner diameter: 85 mm) of the aluminum alloy D shown in Table 1 was homogenized, extruded, softened, drawn, subjected to a solution treatment, and quenched under the conditions shown in Table 3. The quenched product was subjected to natural aging at room temperature for 7 days to obtain a test material (test materials 17 to 28).

The billet was extruded using an indirect extrusion method, and the softened product was cooled inside a furnace. The solution treatment was performed by heating the drawn product to the temperature shown in Table 3 over 30 minutes using an atmospheric furnace, and holding the drawn product at the temperature shown in Table 3 for the time shown in Table 3. The test material 26 was quenched by forced air cooling after the solution treatment, and the test materials 17 to 25, 27, and 28 were quenched in water at room temperature. The test material 27 was subjected to stretch straightening by 0.5% when 1 hour had elapsed after quenching, and the test material 28 was subjected to stretch straightening by 3% when 24 hours had elapsed after quenching.

The average crystal grain size, the ratio of tensile strength/yield strength, the grain boundary coverage by precipitates, and the presence or absence of orange peel after bending were determined in the same manner as in Example 1 using the test materials 17 to 28. The results are shown in Table 4.

TABLE 3

(mass %)

| | Homogenization | | Extrusion: Heating | | Extrusion: Outer diameter and inner diameter of extruded material | | Softening | | Drawing: Outer diameter and inner diameter | Drawing: Drawing ratio | Solution treatment | | Quenching: Average cooling rate down |
|---|---|---|---|---|---|---|---|---|---|---|---|---|---|
| Test material | Temperature (° C.) | Time (h) | Temperature (° C.) | Product speed (m/min) | | Extrusion ratio | Temperature (° C.) | Time (h) | | | Temperature (° C.) | Time (min) | to 100° C. (° C./sec) |
| 17 | 520 | 10 | 350 | 15 | 95 × 85 | 39.5 | 380 | 1 | 90 × 82 | 24 | 540 | 10 | 100 |
| 18 | 560 | 2 | 350 | 15 | 95 × 85 | 39.5 | 380 | 1 | 90 × 82 | 24 | 540 | 10 | 100 |
| 19 | 540 | 10 | 300 | 20 | 97 × 85 | 32.6 | 380 | 1 | 90 × 82 | 37 | 540 | 10 | 100 |
| 20 | 540 | 10 | 500 | 10 | 95 × 85 | 39.5 | 380 | 1 | 90 × 82 | 24 | 540 | 10 | 100 |
| 21 | 540 | 10 | 350 | 15 | 95 × 85 | 39.5 | 350 | 5 | 90 × 82 | 24 | 540 | 10 | 100 |
| 22 | 540 | 10 | 350 | 15 | 95 × 85 | 39.5 | 400 | 1 | 90 × 82 | 24 | 540 | 10 | 100 |
| 23 | 540 | 10 | 350 | 15 | 95 × 85 | 39.5 | 380 | 1 | 90 × 81 | 15 | 540 | 10 | 100 |
| 24 | 540 | 10 | 350 | 15 | 95 × 85 | 39.5 | 380 | 1 | 90 × 82 | 24 | 530 | 20 | 100 |
| 45 | 540 | 10 | 350 | 15 | 95 × 85 | 39.5 | 380 | 1 | 90 × 82 | 24 | 560 | 10 | 100 |
| 26 | 540 | 10 | 350 | 15 | 95 × 85 | 39.5 | 380 | 1 | 90 × 82 | 24 | 540 | 10 | 12 |
| 27 | 540 | 10 | 350 | 15 | 95 × 85 | 39.5 | 380 | 1 | 90 × 82 | 24 | 540 | 10 | 100 |
| 28 | 540 | 10 | 350 | 15 | 95 × 85 | 39.5 | 380 | 1 | 90 × 82 | 24 | 540 | 10 | 100 |

TABLE 4

| Test material | Average crystal grain size (μm) | Tensile strength (MPa) | Yield strength (MPa) | Tensile strength/yield strength | Grain boundary coverage by precipitates (%) | Presence or absence of orange peel after bending |
|---|---|---|---|---|---|---|
| 17 | 64 | 352 | 220 | 1.6 | 5 | Absent |
| 18 | 72 | 360 | 223 | 1.6 | 6 | Absent |
| 19 | 63 | 356 | 222 | 1.6 | 5 | Absent |
| 20 | 68 | 350 | 221 | 1.6 | 6 | Absent |
| 21 | 60 | 358 | 223 | 1.6 | 6 | Absent |
| 22 | 65 | 356 | 221 | 1.6 | 5 | Absent |
| 23 | 97 | 350 | 225 | 1.6 | 8 | Absent |
| 24 | 66 | 355 | 227 | 1.6 | 6 | Absent |
| 25 | 69 | 368 | 231 | 1.6 | 4 | Absent |
| 26 | 66 | 348 | 215 | 1.6 | 18 | Absent |
| 27 | 62 | 359 | 230 | 1.6 | 4 | Absent |
| 28 | 61 | 367 | 240 | 1.5 | 5 | Absent |

As shown in Table 4, when using the test materials 17 to 28, the inner part of the test material had a microstructure having an average crystal grain size of 200 μm or less, the ratio of tensile strength/yield strength was 1.5 or more, the grain boundary coverage by precipitates was 30% or less, and orange peel was not observed after bending (i.e., the test materials 17 to 28 exhibited excellent bendability). The test materials 17 to 28 did not show twisting and curving that exceeded the allowable ranges. In particular, a further improvement (reduction) in twisting and curving was observed for the test materials 27 and 28.

Comparative Example 1

A hollow billet (outer diameter: 280 mm, inner diameter: 85 mm) of the aluminum alloy (alloys P to V) shown in Table 5 was homogenized, extruded, softened, drawn, subjected to a solution treatment, quenched, and subjected to natural aging under the same conditions as those employed in Example 1 to obtain a test material (test materials 29 to 35). In Table 5, the values that fall outside the conditions according to the invention are underlined.

The average crystal grain size, the ratio of tensile strength/yield strength, the grain boundary coverage by precipitates, and the presence or absence of orange peel after bending were determined in the same manner as in Example 1 using the test materials 29 to 35. The results are shown in Table 6. In Table 6, the values that fall outside the conditions according to the invention are underlined.

TABLE 5

(mass %)

| Alloy | Cu | Mg | Si | Mn | Cr | Zr | V | Ti | B (ppm) | Fe | Zn | Al |
|---|---|---|---|---|---|---|---|---|---|---|---|---|
| Q | 0.9 | 0.4 | 0.4 | 0.08 | 0.00 | 0.00 | 0.01 | 0.02 | 23 | 0.12 | 0.01 | Balance |
| R | 2.7 | 1.6 | 1.7 | 0.07 | 0.00 | 0.01 | 0.00 | 0.03 | 30 | 0.14 | 0.00 | Balance |
| S | 1.7 | 1.0 | 0.8 | 0.38 | 0.10 | 0.07 | 0.06 | 0.09 | 28 | 0.07 | 0.01 | Balance |
| T | 1.8 | 0.9 | 0.7 | 0.18 | 0.32 | 0.06 | 0.07 | 0.08 | 16 | 0.11 | 0.00 | Balance |
| U | 1.7 | 1.0 | 0.9 | 0.19 | 0.09 | 0.17 | 0.07 | 0.10 | 22 | 0.13 | 0.00 | Balance |
| V | 1.7 | 1.0 | 0.8 | 0.19 | 0.10 | 0.07 | 0.16 | 0.10 | 26 | 0.13 | 0.01 | Balance |
| W | 1.8 | 1.0 | 0.9 | 0.08 | 0.00 | 0.00 | 0.01 | 0.17 | 56 | 0.14 | 0.00 | Balance |

TABLE 6

| Test material | Alloy | Average crystal grain size (μm) | Tensile strength (MPa) | Yield strength (MPa) | Tensile strength/yield strength | Grain boundary coverage by precipitates (%) | Presence or absence of orange peel after bending |
|---|---|---|---|---|---|---|---|
| 29 | Q | 62 | 178 | 85 | 2.1 | 1 | Absent |
| 30 | R | 53 | 342 | 251 | 1.4 | 12 | — |
| 31 | S | 58 | 361 | 228 | 1.6 | 8 | — |
| 32 | T | 60 | 359 | 230 | 1.6 | 9 | — |
| 33 | U | 55 | 365 | 237 | 1.5 | 7 | — |
| 34 | V | 61 | 355 | 222 | 1.6 | 8 | — |
| 35 | W | 58 | 358 | 230 | 1.6 | 9 | — |

As shown in Table 6, the test material 29 exhibited a low strength since the Cu content, the Mg content, and the Si content were less than the respective lower limits. The ratio of tensile strength/yield strength of the test material 30 was smaller than the lower limit, and cracks occurred during bending since the Cu content, the Mg content, and the Si content exceeded the respective upper limits.

When using the test material 31 in which the Mn content exceeded the upper limit, the test material 32 in which the Mn content exceeded the upper limit, the test material 33 in which the Zr content exceeded the upper limit, the test material 34 in which the V content exceeded the upper limit, and the test material 35 in which the Ti content and the B content exceeded the respective upper limits, coarse crystallized products were produced during casting, and cracks occurred during bending.

Comparative Example 2

A hollow billet (outer diameter: 280 mm, inner diameter: 85 mm) of the aluminum alloy D shown in Table 1 was homogenized, extruded, softened, drawn, subjected to a solution treatment, and quenched under the conditions shown in Table 7. The quenched product was subjected to natural aging at room temperature for 7 days to obtain a test material (test materials 36 to 51). In Table 7, the values that fall outside the conditions according to the invention are underlined.

The billet was extruded using an indirect extrusion method, and the softened product was cooled inside a furnace. The solution treatment was performed by heating the drawn product to the temperature shown in Table 7 over 30 minutes using an atmospheric furnace, and holding the drawn product at the temperature shown in Table 7 for the time shown in Table 7. The test material 50 was quenched by air cooling after the solution treatment, and the test materials 36 to 49 and 51 were quenched in water at room temperature. The test material 51 was subjected to stretch straightening at room temperature by 4% when 1 hour had elapsed after quenching, and then subjected to natural aging at room temperature for 7 days.

The average crystal grain size, the ratio of tensile strength/yield strength, the grain boundary coverage by precipitates, and the presence or absence of orange peel after bending were determined in the same manner as in Example 1 using the test materials 36 to 51. The results are shown in Table 8. In Table 8, the values that fall outside the conditions according to the invention are underlined.

TABLE 7

| | Homogenization | | Extrusion | | | | Softening | | Drawing | | Solution treatment | | Quenching |
|---|---|---|---|---|---|---|---|---|---|---|---|---|---|
| Test material | Temperature (° C.) | Time (h) | Heating temperature (° C.) | Product speed (m/min) | Outer diameter and inner diameter of extruded material (mm) | Extrusion ratio | Temperature (° C.) | Time (h) | Outer diameter and inner diameter (mm) | Drawing ratio (%) | Temperature (° C.) | Time (min) | Average cooling rate down to 100° C. (° C./sec) |
| 36 | 510 | 2 | 350 | 15 | 95 × 85 | 39.5 | 380 | 1 | 90 × 82 | 24 | 540 | 10 | 100 |
| 37 | 520 | 1 | 350 | 15 | 95 × 85 | 39.5 | 380 | 1 | 90 × 82 | 24 | 540 | 10 | 100 |
| 38 | 570 | 10 | 350 | 15 | 95 × 85 | 39.5 | 380 | 1 | 90 × 82 | 24 | 540 | 10 | 100 |
| 39 | 540 | 10 | 250 | 15 | 95 × 85 | 39.5 | 380 | 1 | 90 × 82 | 24 | 540 | 10 | 100 |
| 40 | 540 | 10 | 520 | 15 | 95 × 85 | 39.5 | 380 | 1 | 90 × 82 | 24 | 540 | 10 | 100 |
| 41 | 540 | 10 | 350 | 5 | 95 × 85 | 39.5 | 380 | 1 | 90 × 82 | 24 | 540 | 10 | 100 |
| 42 | 540 | 10 | 350 | 15 | 100 × 85 | 25.6 | 380 | 1 | 90 × 82 | 17 | 560 | 60 | 100 |
| 43 | 540 | 10 | 350 | 15 | 95 × 85 | 39.5 | 320 | 1 | 90 × 82 | 24 | 540 | 10 | 100 |
| 44 | 540 | 10 | 350 | 15 | 95 × 85 | 39.5 | 430 | 1 | 90 × 82 | 24 | 540 | 10 | 100 |
| 45 | 540 | 10 | 350 | 15 | 95 × 85 | 39.5 | 350 | 0.4 | 90 × 82 | 24 | 540 | 10 | 1 |
| 46 | 540 | 10 | 350 | 15 | 95 × 85 | 39.5 | 380 | 1 | 91 × 82 | 14 | 540 | 10 | 100 |
| 47 | 540 | 10 | 350 | 15 | 95 × 85 | 39.5 | 380 | 1 | 90 × 82 | 24 | 520 | 10 | 100 |
| 48 | 540 | 10 | 350 | 15 | 95 × 85 | 39.5 | 380 | 1 | 90 × 82 | 24 | 570 | 10 | 100 |
| 49 | 540 | 10 | 350 | 15 | 95 × 85 | 39.5 | 380 | 1 | 90 × 82 | 24 | 530 | 5 | 100 |
| 50 | 540 | 10 | 350 | 15 | 95 × 85 | 39.5 | 380 | 1 | 90 × 82 | 24 | 540 | 10 | 5 |
| 51 | 540 | 10 | 350 | 15 | 95 × 85 | 39.5 | 380 | 1 | 90 × 82 | 24 | 540 | 10 | 100 |

Note:

The test material 51 was subjected to stretch straightening at room temperature by 4% when 1 hour had elapsed after quenching, and then subjected to natural aging at room temperature for 7 days.

TABLE 8

| Test material | Average crystal grain size (μm) | Tensile strength (MPa) | Yield strength (MPa) | Tensile strength/yield strength | Grain boundary coverage by precipitates (%) | Presence or absence of orange peel after bending |
|---|---|---|---|---|---|---|
| 36 | 61 | 354 | 220 | 1.6 | 8 | — |
| 37 | 60 | 350 | 222 | 1.6 | 7 | — |
| 38 | — | — | — | — | — | — |
| 39 | — | — | — | — | — | — |
| 40 | — | — | — | — | — | — |
| 41 | 220 | 347 | 216 | 1.6 | 12 | Present |

TABLE 8-continued

| Test material | Average crystal grain size (μm) | Tensile strength (MPa) | Yield strength (MPa) | Tensile strength/ yield strength | Grain boundary coverage by precipitates (%) | Presence or absence of orange peel after bending |
|---|---|---|---|---|---|---|
| 42 | 225 | 344 | 218 | 1.6 | 13 | Present |
| 43 | — | — | — | — | — | — |
| 44 | — | — | — | — | — | — |
| 45 | — | — | — | — | — | — |
| 46 | 312 | 332 | 210 | 1.6 | 16 | Present |
| 47 | 62 | 312 | 220 | 1.4 | 6 | — |
| 48 | — | — | — | — | — | — |
| 49 | 61 | 316 | 219 | 1.4 | 7 | — |
| 50 | 65 | 333 | 210 | 1.6 | 35 | — |
| 51 | 66 | 370 | 259 | 1.4 | 6 | — |

As shown in Table 8, cracks occurred during bending when using the test material 36 (the homogenization temperature was less than the lower limit) and the test material 37 (the homogenization time was less than the lower limit). Melting occurred during homogenization when producing the test material 38 since the homogenization time exceeded the upper limit. Clogging occurred when producing the test material 39 since the billet heating temperature during extrusion was less than the lower limit. Cracks occurred during extrusion when producing the test material 40 since the billet heating temperature during extrusion exceeded the upper limit.

The average crystal grain size exceeded the upper limit, and orange peel occurred during bending when using the test material 41 since the product speed during extrusion was less than the lower limit. The average crystal grain size exceeded the upper limit, and orange peel occurred during bending when using the test material 42 since the extrusion ratio was less than the lower limit. Cracks occurred during drawing when producing the test material 43 since the softening temperature was less than the lower limit. Cracks occurred during drawing when producing the test material 44 since the softening temperature exceeded the upper limit. Cracks occurred during drawing when producing the test material 45 since the softening time was less than the lower limit.

The average crystal grain size exceeded the upper limit, and orange peel occurred during bending when using the test material 46 since the drawing ratio was less than the lower limit. A decrease in strength was observed, the ratio of tensile strength/yield strength was smaller than the lower limit, and cracks occurred during bending when using the test material 47 since the solution treatment temperature was less than the lower limit. Melting occurred during the solution treatment when producing the test material 48 since the solution treatment time exceeded the upper limit. A decrease in strength was observed, the ratio of tensile strength/yield strength was smaller than the lower limit, and cracks occurred during bending when using the test material 49 since the solution treatment time was less than the lower limit. The grain boundary coverage by precipitates exceeded the upper limit, and cracks occurred during bending when using the test material 50 since the cooling rate during quenching was less than the lower limit. The ratio of tensile strength/yield strength was smaller than the lower limit, and cracks occurred during bending when using the test material 51 since the ratio of stretch straightening exceeded the upper limit.

Although only some exemplary embodiments and/or examples of the invention have been described in detail above, those skilled in the art will readily appreciate that many modifications are possible in the exemplary embodiments and/or examples without materially departing from the novel teachings and advantages of the invention. Accordingly, all such modifications are intended to be included within the scope of the invention.

The documents described in the specification are incorporated herein by reference in their entirety.

What is claimed is:

1. An aluminum alloy pipe material exhibiting excellent bendability, the aluminum alloy pipe material being a T4-tempered material formed of an Al—Cu—Mg—Si alloy comprising 1.5 to 2.5 mass % of Cu, 0.8 to 1.5 mass % of Mg, and 0.5 to 1.5 mass % of Si, with the balance being aluminum and unavoidable impurities, the aluminum alloy pipe material being obtained by a process comprising step (a) of homogenizing a billet of the Al—Cu—Mg—Si alloy, step (b) of hot-extruding the billet, step (c) of softening the extruded material, step (d) of cold-working the softened extruded material, step (e) of subjecting the cold worked extruded material to a solution treatment, step (f) of quenching the solution treated material, and step (g) of performing natural aging at room temperature, the homogenizing being performed at a temperature of 520° C. to 560° C. for at least 2 hours, the hot-extruding being performed at a temperature of 300° C. to 500° C., the softening being performed at a temperature of 350° C. to 400° C. for at least 30 minutes, the cold-working being performed at a working ratio of at least 15%, the solution treatment being performed at a temperature of 530° C. to 560° C. and at a time of at least 10 minutes, the quenching being performed so that an average cooling rate from the solution treatment temperature to 100° C. is at least 10° C./sec, and the natural aging being performed for at least 7 days, a matrix that forms an inner part of the aluminum alloy pipe material having a microstructure formed by recrystallized grains having an average crystal grain size of no more than 200 μm, and the aluminum alloy pipe material having a tensile strength of from 308-409 MPa, a yield strength of from 194-245 MPa, and a ratio of tensile strength (MPa)/yield strength (MPa) of at least 1.5.

2. The aluminum alloy pipe material exhibiting excellent bendability according to claim 1, wherein the average crystal grain size is 47 to 200 μm.

3. The aluminum alloy pipe material according to claim 1, wherein the Al—Cu—Mg—Si alloy further comprises at least one of up to 0.35 mass % of Mn, up to 0.30 mass % of Cr, up to 0.15 mass % Zr, and up to 0.15 mass % of V, at least one of Mn, Cr, Zr and V being present in the aluminum alloy pipe material.

4. The aluminum alloy pipe material according to claim 1, wherein the Al—Cu—Mg—Si alloy further comprises at least one of 0.15 mass % or less of Ti and 50 ppm or less of B.

5. The aluminum alloy pipe material according to claim 3, wherein the Al—Cu—Mg—Si alloy further comprises at least one of 0.15 mass % or less of Ti and 50 ppm or less of B.

6. The aluminum alloy pipe material according to claim 1, wherein the matrix that forms the inner part of the aluminum alloy material has a grain boundary coverage by precipitates of 30% or less.

7. The aluminum alloy pipe material according to claim 3, wherein the matrix that forms the inner part of the aluminum alloy material has a grain boundary coverage by precipitates of 30% or less.

8. The aluminum alloy pipe material according to claim 4, wherein the matrix that forms the inner part of the aluminum alloy material has a grain boundary coverage by precipitates of 30% or less.

* * * * *